US005079988A

United States Patent [19]

Raymond

[11] Patent Number: 5,079,988

[45] Date of Patent: Jan. 14, 1992

[54] HYDRAULIC SENSOR AND TRANSDUCING APPARATUS

[76] Inventor: Robert E. Raymond, 495 Military Dr., Zanesville, Ohio 43701

[21] Appl. No.: 456,734

[22] Filed: Dec. 26, 1989

[51] Int. Cl.[5] ..... F15B 13/16

[52] U.S. Cl. ..... 91/359; 91/386; 91/387; 91/388

[58] Field of Search ..... 91/339, 340, 218, 281, 91/284, 286, 304, 330, 357, 358, 359, 365, 386, 387, 388, 390; 60/369, 459

[56] References Cited

U.S. PATENT DOCUMENTS

| | | | |
|---|---|---|---|
| 2,057,317 | 10/1936 | Ruud | 91/339 |
| 2,223,792 | 12/1940 | Muir | 91/284 |
| 2,389,232 | 11/1945 | Conlon | 91/339 |
| 2,989,950 | 6/1961 | Lockman | 91/365 X |
| 3,058,450 | 10/1962 | Lissou | 91/357 X |
| 3,125,002 | 3/1964 | McCombs, Jr. | 91/365 |
| 3,164,065 | 1/1965 | Frantz | 91/365 |
| 3,215,044 | 11/1965 | Lissau | 91/390 X |
| 3,215,045 | 11/1965 | Lissau | 91/390 X |
| 3,388,637 | 6/1968 | Haas et al. | 91/339 |
| 3,592,104 | 7/1971 | Harness | 91/339 |
| 3,971,213 | 7/1976 | Kelley | 91/218 X |
| 4,421,012 | 12/1983 | Mucheyer et al. | 91/388 |
| 4,510,847 | 4/1985 | Mucheyer et al. | 91/388 X |
| 4,519,296 | 5/1985 | Schulte | 91/388 |
| 4,574,687 | 3/1986 | Kauss et al. | 91/388 X |

FOREIGN PATENT DOCUMENTS 0540060 12/1986 U.S.S.R. ..... 91/339

*Primary Examiner*—Edward K. Look
*Assistant Examiner*—John Ryznic
*Attorney, Agent, or Firm*—Francis T. Kremblas, Jr.

[57] ABSTRACT

A hydraulic sensor and pressure transducing apparatus is disclosed which is characterized by the use of a biased piston and valve element arrangement to translate the displacement of an actuator to provide a pressure signal proportional to the displacement being sensed. The piston is mounted in a bore provided with inlet and outlet ports. A valve element is positioned in the bore in an opposing resiliently biased relationship to the piston in communication between the inlet and outlet ports. A constant selected hydraulic flow is fed into the bore inlet through the valve element and out of the bore outlet port to develop a pressure on the inlet port side which is proportionally to the displacement of the piston as reflected by the biased force exerted against the valve element. An actuator is linked to the piston by a cam surface in a manner that permits the angular position of the cam operating on the piston to be reflected as a proportional pressure on the inlet side of the valve element. A preferred embodiment is disclosed utilizing a dual sensor piston arrangement such as described in a feedback control circuit to effectively control the position of the actuator via a selected means of hydraulic control.

10 Claims, 4 Drawing Sheets

HYDRAULIC SENSOR AND TRANSDUCING APPARATUS

TECHNICAL FIELD

The present invention relates generally to fluid power and particularly to apparatus for sensing displacement of an actuator and transducing the displacement to a proportional pressure signal.

BACKGROUND ART

Many varied applications utilize sensing means for detecting the position of a rotary or linear actuator to either merely detect such displacement or utilize a signal generated to perform a control function. For many years the preferred sensing means has been electrical wherein the displacement being sensed is converted to an electrical signal. Such apparatus are accurate and have found widespread acceptance.

However, in certain applications it is undesirable and/or unreliable to employ electronic components due to surrounding conditions in which the sensing transducing means are exposed. Therefore it would be highly desirable to provide means to hydraulically sense displacement and transduce the displacement to a proportional pressure signal for position indication or control purposes.

While the fluid power art is very old, prior to the present invention there has been a long unfilled need for an accurate, reliable and relatively simple apparatus for hydraulically sensing and transducing displacement of an actuator to provide a proportional pressure signal, particularly for pilot control functions utilizing low fluid flows.

BRIEF DISCLOSURE OF INVENTION

The present invention relates generally to fluid power and particularly to novel apparatus and method for hydraulically sensing displacement of an actuator and converting the displacement to a pressure signal for position indication or control functions. The present invention includes a sensor piston slideably disposed in a bore in a resiliently biased disposition with a valve element communicating with an inlet and outlet port provided in the bore.

Means in the form of a pump and a flow regulator are provided to supply a continuous, constant flow rate of fluid to the sensor inlet port communicating with the valve element such that the linear displacement of the piston is reflected as a pressure signal at the inlet port receiving the constant flow rate of hydraulic fluid. An actuator is disposed in force transmitting engagement either directly or indirectly with the piston so that the piston reflects the displacement of the actuator.

In the preferred embodiment disclosed, a rotary cam surface is provided which engages the piston to convert the angular position of the cam to linear displacement of the piston within the bore. The cam in turn may be operatively connected to a rotary or linear actuator to link displacement of the actuator to displacement of the piston to develop a proportional pressure signal at the sensor inlet port.

As one aspect of the present invention, the apparatus for sensing displacement and converting the displacement into a proportional pressure signal is relatively simple in structure and may be manufactured economically employing typical manufacturing processes.

As another aspect of the present invention, an apparatus of the type described provides a highly accurate and reliable device for detecting actuator position which can be employed in a feed-back circuit to control actuator position.

As another aspect of the present invention, a dual piston-valve assembly such as described may be conveniently made to permit manufacture of a standardized apparatus which lends itself to a more efficient installation, repair, maintenance and replacement in certain applications requiring the sensing and control of both clockwise and counterclockwise angular positions by merely plugging or otherwise switching flow input lines to the sensor inlet port of the appropriate, operative one of the piston-valve assemblies associated with a single actuator.

It is therefore an object of the present invention to provide a relatively simple, inexpensive hydraulic sensor and transducing apparatus which combines the advantages of non-electrical components with accuracy and reliability favorably comparable to electric sensors for certain practical applications.

It is another object of the present invention to provide an apparatus of the type described which may be manufactured using relatively inexpensive standard components and standard manufacturing processes lending to efficient, high volume production.

It is another object of the present invention to provide apparatus of the type described in a preferred embodiment which can be used to provide a substantially linear proportional relationship between the angular displacement and pressure signal generated through a significant arc of the angular displacement.

It is a further object of the present invention to provide an apparatus of the type described which incorporates an annular slot through the bore carrying the piston through which an annular cam surface extends to provide a greater piston stroke length relative to the overall length of the piston to reduce the overall length of the cam and sensor housing structure.

It is yet another object of the present invention to provide an apparatus of the type described which includes means to movably adjust the axial position of valve seat in the bore carrying the sensor piston to provide means for more easily pre-selecting an initial actuator position relative to the low end of a predetermined operating sensing pressure range.

Further objects and advantages of the present invention will be apparent from the following description, references being had to the accompanying drawings wherein a preferred form of embodiment of the invention is clearly shown.

Figure 1:
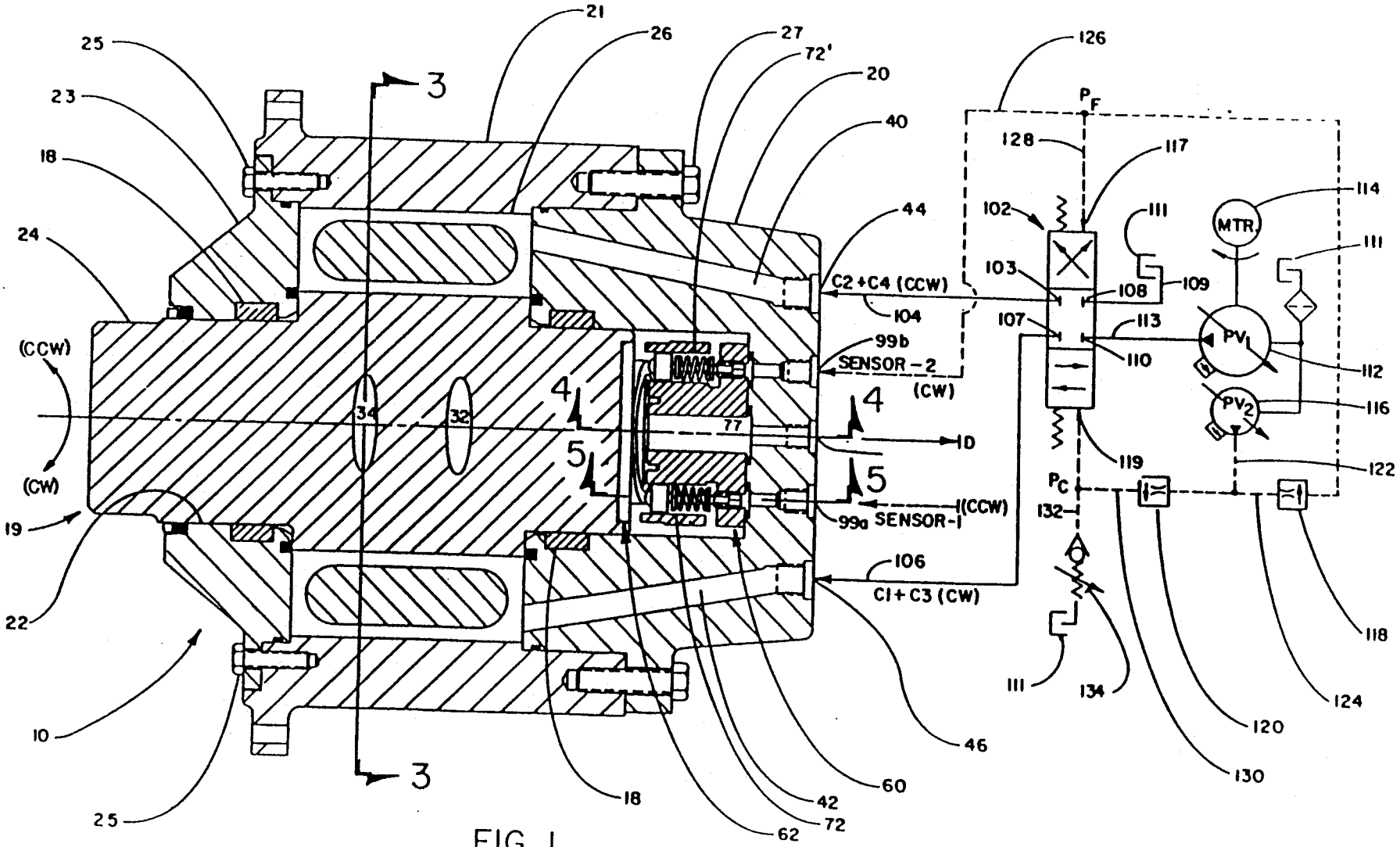
FIG. 1 is a side elevational view, in section, of a hydraulic sensing and transducing apparatus constructed in accordance with the present invention and a typical control circuit shown in diagrammatic form, the section being taken along line 1—1 in FIG. 2.
Figure 2:
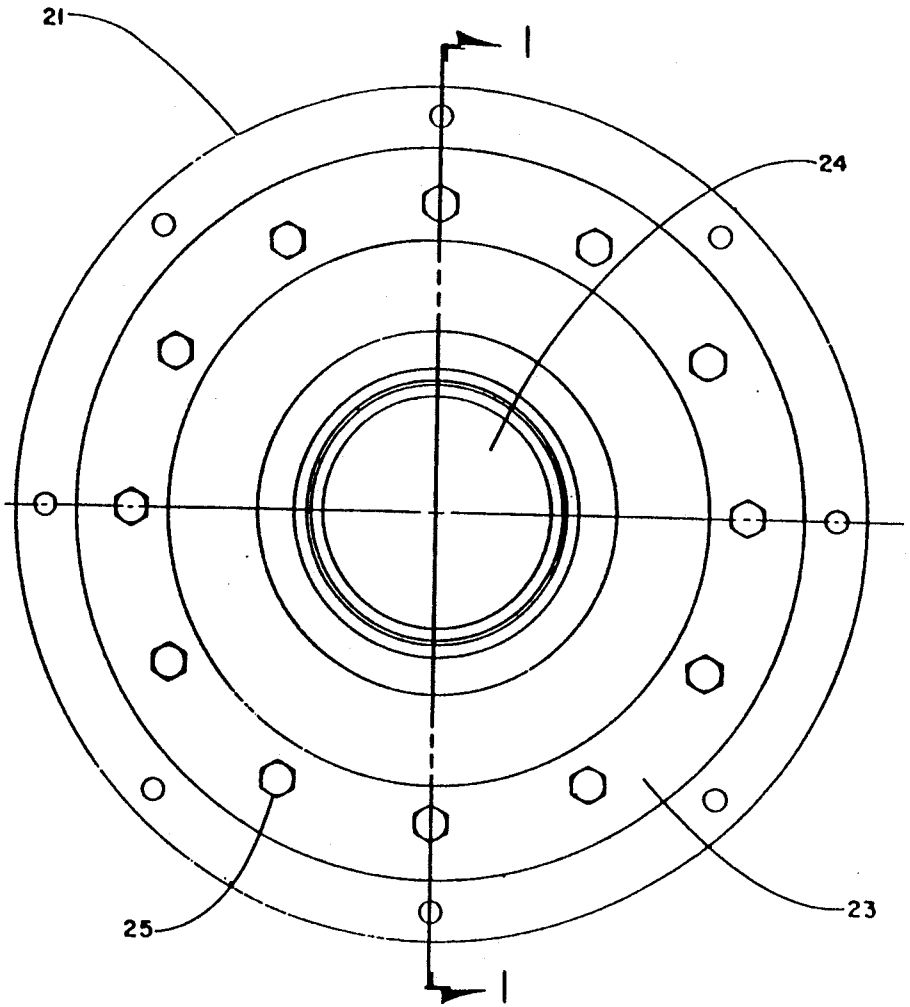
FIG. 2 is an end elevational view of the apparatus shown in FIG. 1.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other circuit elements where such connection is recognized as being equivalent by those skilled in the art.

DETAILED DESCRIPTION

An apparatus for sensing and transducing a power actuator displacement to a proportional pressure signal constructed in accordance with the present invention and a typical diagrammatic hydraulic control circuit which can be usefully operated therewith is illustrated in FIG. 1. A conventional two vane rotary actuator is shown for illustrative purposes in describing an embodiment of the invention, however, it should be understood that other well-known forms of rotary as well as linear actuators could be usefully employed within the spirit of the present invention. The mechanical components and arrangement thereof to link the actuator displacement to displacement of the sensor piston and spring engaging the valve element as described herein may vary from the embodiments disclosed according to the demands or design of the particular application using conventional engineering skills.

Figure 3:
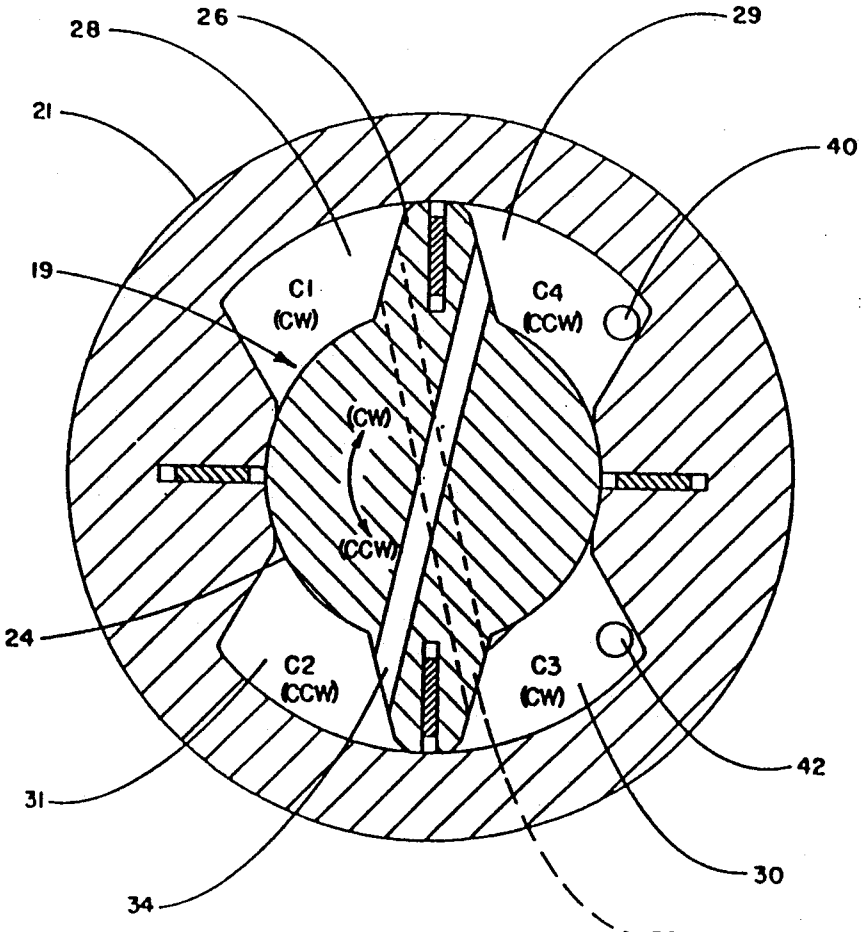
FIG. 3 is an end elevational view, in section, of the apparatus shown in the preceding Figures, the section being taken along line 3—3 in FIG. 1.

As seen in FIGS. 1 and 3, an actuator housing indicated generally at 10, with a rear housing portion 20, an annular central portion 21, and an annular front portion 23 conventionally joined by threaded fasteners, such as at 25 and 27. These assembled components form a recess 22 which rotatably receives a rotary actuator and shaft assembly indicated generally at 19. Shaft assembly 19 includes a shaft 24 provided with vanes 26. In typical fashion, each vane 26 separates a pair of opposing chambers 28, 29, 30 and 31. Multiple seals are conventionally disposed at various locations between the shaft, vanes and housing components in a typical well-known manner and bearings 18 are provided in a conventional manner.

Chambers 28 and 30 are communicated to one another via a drilled fluid path 32 in shaft assembly 19 and chambers 29 and 31 are similarly communicated to one another via a drilled fluid path 34. Chambers 29 and 30 communicated to a respective housing port 44 and 46 via drilled paths 40 and 42 formed in rear housing portion 20.

From the foregoing description it should be readily understood to one skilled in the art that an increase in fluid pressure delivered to port 44 tends to drive the vanes 26 in a counterclockwise direction and the opposite is true when pressure is increased via port 46.

A sensing apparatus, indicated generally at 60, which also transduces displacement of a piston in a bore to a pressure signal is mounted in the right end of recess 22 as shown in FIG. 1.

Figure 6:
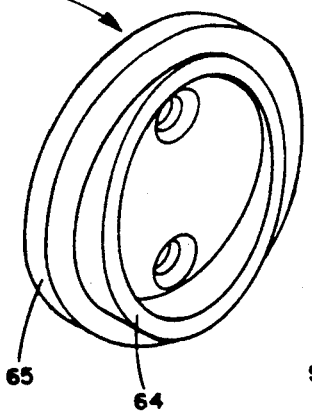
FIG. 6 is a perspective view of the rotary cam employed in the present invention shown removed from the remainder of the apparatus.
Figure 7:
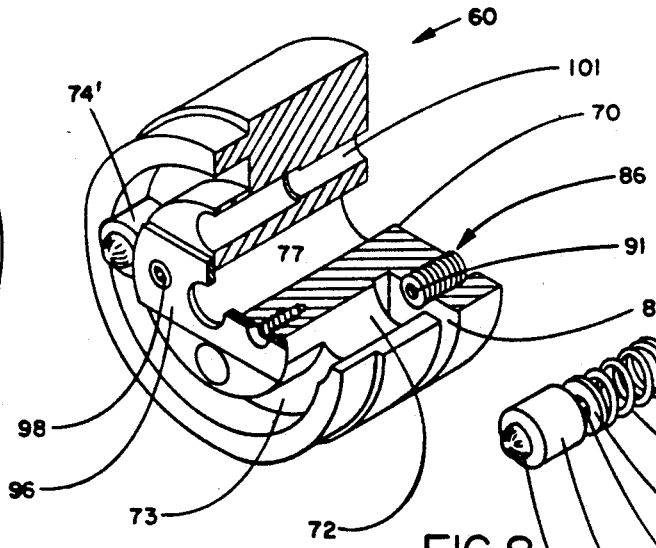
FIG. 7 is a perspective view of a portion of the sensing apparatus shown in a removable kit form and partially in section which forms a part of one preferred embodiment of the present invention.
Figure 4:
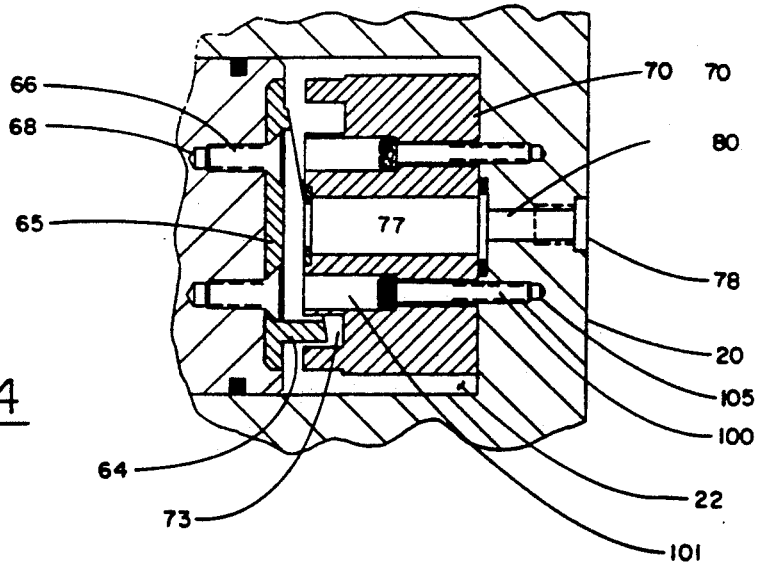
FIG. 4 is a partial, plan sectional view of a portion of the sensing apparatus shown in FIG. 1 illustrating the relationship between the rotary cam surface and the slot provided within the bores of the sensing portion with the piston means removed for clarity. The section is taken along line 4—4 in FIG. 1.

In the embodiment shown, assembly 60 may be conveniently manufactured in a kit assembly form and includes a driver in the form of a rotary cam indicated generally at 62 fixed to the right end of shaft 24 for rotation therewith. Cam 62 is provided with an annular ring-like inclined cam surface 64 as best seen in FIG. 6. The degree of inclination perpendicular to the axis of shaft 24 is selected to convert a given degree of rotation of shaft 24 into a given linear displacement of a cam follower in the form of a piston 74 described later herein. Cam 62 is provided with a mounting body or plate 65 having appropriate holes to accommodate mounting screws 66 which are conventionally received within threaded bores 68 provided in the end of shaft 24, as best seen in FIG. 4.

With specific reference to FIGS. 1 and 4–8 an annular piston bore sub-housing or cylinder barrel 70 is included in assembly 60 and is provided with a pair of piston bores 72, 72', each adapted to receive a piston 74 and 74'. Each piston is provided with a ball end 71. A central bore in housing 70 forms a drain path 77 communicating with housing drain port 78 via drilled passage 80. In turn, port 78 may be conventionally communicated to tank.

Bores 72 and 72' are provided with a respective outlet port 82, 82' which communicate with the interior space between the walls of recess 22 and drain path 77.

Bores 72 and 72', pistons 74 and 74' and the other associated components are identical in construction and function, therefore for purposes of brevity, only one such assembly will be described below with respect to the remaining associated components. Those components having the same reference numerals are identical in construction and function for purposes of the present invention.

Figure 5:
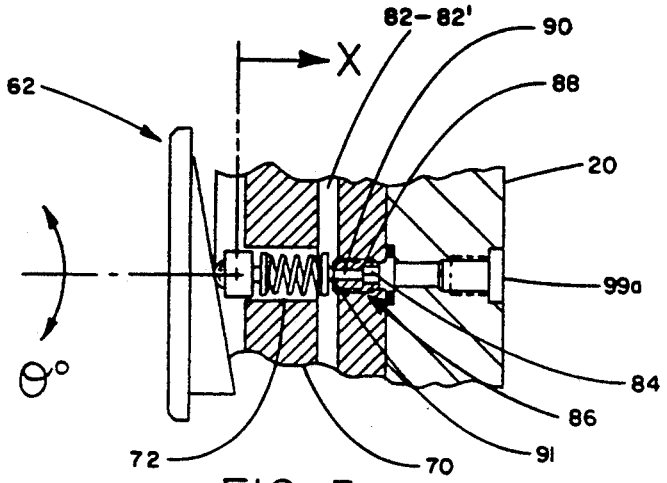
FIG. 5 is a partial, plan sectional view of a portion of the sensor apparatus, the section being taken along line 5—5 in FIG. 1.

As best seen in FIGS. 4 and 5, bore 72 is provided with an inlet port 84 formed in a threaded plug member 86 adapted to be received in a threaded bore 88 provided in housing 70. Plug member 86 is provided with a central bore 90 terminating at its inner end in a valve seat 91 adapted to receive a ball valve element 92.

Figure 8:
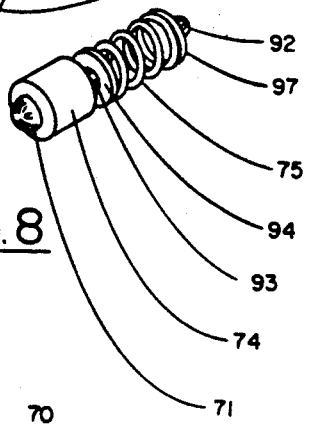
FIG. 8 is a perspective view of a piston, spring and ball valve assembly which forms a portion of a preferred embodiment of the present invention.

As seen in FIGS. 5 and 8, a ball type pivot member 93 and a ball pivot adapter plate 94 are provided between piston 74 and spring 75. A ball poppet adapter 97 is disposed at the opposing end of spring 75 to receive the ball poppet element 92. This construction is preferred to reduce lateral frictional forces between the contacting members in the force chain formed between piston 74 and valve element 92.

A compression spring 75 is mounted in bore 72 between piston 74 and ball element 92. Piston 74 is held in position for assembly purposes by an annular retaining plate 96 fixed via threaded screws 98 to housing 70. Once assembled, the initial spring force upon ball elements 92 may be selected by adjustment of a respective one of threaded plug members 86 within their threaded bores which moves valve seat 91 axially toward or away from the extreme left end of each bore 72 or 72' as seen in FIG. 1.

This construction permits the setting of a pre-selected minimum starting pressure value of the operative range of the sensing and transducing assembly 60 and provides a means to set, in a sense, calibrate a given initial position of the cam 62 to a given minimum operative starting pressure value. This starting pressure will be greater than zero and usually will be chosen to be 50 to 100 psi, for example. It also provides a means to adjust the relationship between the angular position of the cam as reflected by a unit of length of travel of piston 74 per degree of compression of spring 75, which in turn, is reflected as pressure in the line of the incoming flow of fluid past ball element 92. In other words, adjustability of the axial position of seat 91 provides a given range of flexibility to fine tune the range of pressure change with respect to angular degrees of displacement of cam 62 during or after assembly of the device after certain limits or characteristics have been selected during the design and manufacture of the component parts, such as for example, piston stroke length and the compression force of spring 75.

As seen in the partial view shown in FIG. 4, housing 70 is mounted in the end of recess 22 by two mounting bolts such as 100, extended through recessed bores, such as 101, in housing 70 and received by drilled and threaded bores, such as 105, provided in housing 20.

In the form shown herein, assembly 60 is mounted in recess 22 prior to positioning of the shaft 24 and actuator vanes 26 and the complete assembly of the housing portions 20, 21, and 23.

Now referring again to FIG. 1, a diagrammatic representation of a hydraulic circuit, including conventional control components, is shown as one operative example of employing the present invention to sense displacement and transduce the displacement to a pressure signal which may be fed back to control the angular position of the actuator shaft 24.

With respect to the embodiment described herein, it should be noted that the use of an identical dual piston, spring and valve element arrangements is particularly advantageous in an application wherein multiple primary actuators are employed and controlled by a common control signal. Since inclined cam surface 64 represents a rising pressure via compressing the spring 75 through the first 180 degrees of rotation in one direction and a decreasing pressure in the last 180 degrees of rotation relieving the spring; the use of only a single piston sensing arrangement could require a relatively complex hydraulic control circuit which must discriminate between a decreasing pressure and an increasing pressure relating to the same angular position of the actuator shaft.

Depending upon the position of a single piston sensor arrangement relative to the cam surface 64, piston 74 can be said to be in either a clockwise or counterclockwise orientation relative to reacting to rotation of shaft 24 by compressing the biased piston into the bore to cause an increasing pressure signal. Rotation in the opposite direction decreases the pressure signal.

If two piston-spring arrangements are used as described herein and located 180 degrees from one another, one can be designated a clockwise sensor and the other a counterclockwise sensor. Then a single standard actuator assembly can be used regardless of its relative position with respect to a load. This dual arrangement represents a savings in replacement inventory requirements and simplifies control circuitry, particularly in certain common applications. Upon installation, only one sensor arrangement is used and its respective sensor housing port will be connected to the control circuit. The other sensor housing port may be conventionally plugged by a threaded plug member, not shown. Appropriate marking or coding of each housing outlet port for clockwise and counterclockwise designation is recommended for ease of installation to reduce human error.

Therefore in applications wherein the actuator has a limited angular motion in a practical application, the disclosed embodiment offers advantages which are well worth the small increase in cost of component parts to include dual piston arrangements.

Of course, in an application wherein the actuator shaft will not be subjected to rotation in either direction from a common command signal in an application not requiring differentiation between clockwise or counterclockwise rotation, a single sensor assembly may be deemed quite sufficient and the most economical.

As seen in FIGS. 1 and 3, housing inlet port 44 is communicated to one of the ports 103 of a conventional four-way control valve 102 via line 104. This establishes a communication between valve 102 and chambers 31 and 29 via fluid passage 40, and drilled passage 34. An increase in fluid pressure in chambers 29 and 31 tends to rotate vanes 26 in a counterclockwise direction. In a similar manner, actuator chambers 28 and 30 are communicated to another control valve 107 port via drilled passages 32 and 42, housing port 46 and line 106.

Control valve 102 also includes port 108 which is communicated via line 109 to tank 111 and port 110 which is communicated to a conventional source of pressure such as pump 112 via line 113. Pump 112 is operably driven by a suitable motor 114.

A second conventional pump 116 is provided, which may be relatively smaller than pump 112, and delivers a relatively small control or pilot flow of fluid into the circuit. Pump 116 is communicated to a first flow regulator 118 and also to a second flow regulator 120 via lines 122 and 124. Regulators 118 and 120 preferably, are orifice controlled to provide a reasonably precise, constant rate of flow from pump 116 to one of the housing sensor inlet ports **99*a* or 99*b*. In the example shown herein, the flow from pump 116 is directed to sensor inlet port 99*b* which communicates with the designated clockwise piston 74 via line 126**.

The control flow from pump 116 is also communicated to a pilot port 117 of control valve 102 via lines 126 and 128 and to the opposing end of control valve 102 through valve pilot port 119 via flow regulator 120 and lines 130 and 132. An adjustable pressure control valve 134 is connected to line 132 to provide a variable pressure control setting to pilot port 119 of control valve 102 as shown in FIG. 1.

In this relatively simple circuit arrangement, it should be pointed out that the constant flow rate directed through the sensor inlet port 84 will generate a pressure in one direction against ball valve element 92 which is opposed by spring 75. Therefore as cam 62 rotates to displace piston 74 toward or away from valve seat 91, a pressure will be developed on the inlet side of valve element 92 which is proportional to the linear displacement of piston 74 and the angular position of cam 62 relative to a selected starting position. Since this pressure is communicated through lines 126 and 128 to one side of control valve 102, it is opposed by the control pressure pre-set by pressure control valve 134. A differential in the pressure at port 117 versus port 119 will cause the control valve 102 to operate to either increase pressure or decrease pressure in actuator chambers 28, 29, 30 and 31 via lines 104 and 106 according to which of the inlet pressures to the control valve 102 is greater.

When the respective pressure at ports 117 and 119 are equal, the valve 102 is centered to hold the actuator position and responds only when an unbalanced change occurs. This change may occur by changing the set control pressure or may arise by a change in the load bearing upon the actuator shaft 24.

Figure 9:
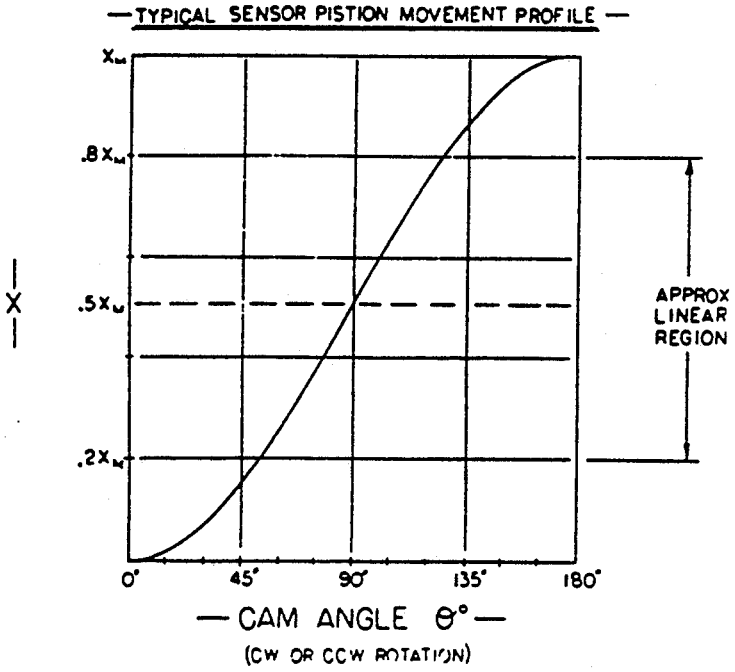
FIG. 9 is a graph of a typical sensor piston movement profile versus the angular rotation of the cam illustrating the substantially linear range employed in a preferred embodiment of the present invention.

FIG. 9 is a graph showing a typical preferred sensor piston movement profile plotting the piston displacement stroke versus the cam angle through 180 degrees of rotation. It should be noted that between approximately 20 and 80 percent of the full stroke length of piston 74, a linear relationship is closely approached for this portion of the curve which is quite convenient to use for many practical applications wherein detection and/or control over this span is quite adequate. This linear relationship also permits relatively simple control circuitry to be employed.

Normally, it would be desirable to make the piston stroke and spring compression great enough so that shaft rotation can generate reasonable increments of pressure per degree of rotation that better suit the hydraulic system which is to respond to the pressure changes.

One would generally want to avoid very small pressure increments per degree of rotation as well as pressure increments so high as to require high power generation and any of the disadvantages commonly associated with high pressure, particularly in pilot functions of this nature.

To accomplish this end the inclined can surface should have a reasonable, but substantial degree of eccentricity to provide a longer piston stroke. However, in the preferred embodiment shown, this longer strike is accomplished in a novel manner that preserves a substantial degree of compactness to the overall length of assembly 60.

This is accomplished by providing an annular slot 73 in housing 70 which extends through each bore 72 or 72'. Ring-shaped cam surface 64 extends into and rides within slot 73 below the end surface of housing 70 and effectively permits a longer guided path of the piston stroke within bore 72 relative to the actual length of piston 74 or 74'. The pistons never extend any substantial distance out of the confines of the bores.

Utilizing this construction provides means to establish a piston length over piston diameter ratio which is very reasonable and yet desirably contributes to overall compactness of assembly 60, while providing a sufficient piston stroke length to develop very reasonable pressure increments per degree of rotation of shaft 24.

It should also be noted that the precision or accuracy of the device shown is substantially effected by the manner and care of the manufacturing and design of the component parts utilized in the system.

In the present instance, the fixed or constant flow rate fed to the piston sensor arrangement through sensor ports **99*a* and 99*b* must be controlled with reasonable accuracy to provide a pressure signal which is reliably proportional to the displacement of pistons 74 or 74'. In the same manner, a ball valve and a reasonably precise seat, such as 91 described herein, provides the preferred embodiment in this arrangement. A relatively low cost precision ball bearing may serve as element 92 which may be coined into the valve seat 91 to offer an economical structure providing high precision as well as good physics in maintaining the ball valve centered as fluid moves through the seat. If sideways or lateral shifting of the valve element 92** relative to the axis of the spring is significant, a substantial reduction in the accuracy of the sensing and transducing function results.

The overall assembly, including the piston 74 guided in bore 72, and the ball end 71 engaging the cam surface 64, are relatively easy to manufacture and assemble with reasonable precision to provide a pressure signal that smoothly and uniformly varies proportionally to the cam and shaft rotation without sticking or frictional engagement which negatively effect accuracy of the measurement.

However, the same freely movable, relatively friction free force chain comprising the piston, spring, ball and seat arrangement is prone to "chatter", that is, oscillate at a rather high natural frequency of a second order spring mass system. Such "chatter" causes noise, but more importantly, may also introduce erratic pressure signals which would amount to an instability sufficient to cause malfunction of the desired sensing or measuring function. However, "chatter" can be effectively reduced or eliminated by the standard and well-known practice of introducing an orifice in series upstream of the seat 91 and ball element 92 to make the system operably stable. Generally, such an orifice restriction, not shown, would be effectively disposed within the passage 90, close to seat 91 in any well-known manner. Other means which would perform the equivalent function could be used without departing from the spirit of the present invention.

With regard to the example control circuit shown, it should be understood by those skilled in the art that when the other sensor port **99*a* is connected into the control circuit via line 126, instead of port 99*b*, the "counterclockwise" sensor piston 74, becomes operational and port 99*b* will be suitably plugged to isolate piston 74** and its associated components.

As described earlier herein, piston sensor 74' is oppositely disposed on cam surface 64 as compared to piston 74. Therefore it reacts to counterclockwise rotation of shaft 24 by compressing its associated compression spring to cause increasing pressure signal to develop at the upstream side of the associated ball element 92. The operation of the control circuit is identical as that previously described relative to clockwise motion of shaft 24 and sensor piston 74.

As earlier referred to herein, in applications utilizing multiple actuators operatively connected to an arm which is pivoted to a body being moved vertically, for example, one may often encounter circumstances wherein certain of the shafts 24 of different actuators are required to move in opposing angular directions upon a common command signal. However, employing a dual sensor piston arrangement as disclosed herein does not require the more complex hydraulic control circuitry necessary to discriminate between counterclockwise and clockwise rotations assuming the appropriate sensor inlet port is connected to the control circuit upon installation of the particular actuator.

The aforementioned clockwise or counterclockwise rotation of shaft 24 may be encountered in applications such as controlling the height of a suitably supported platform such as in vehicle suspensions. Rotation of shaft 24 is reflected in a given vertical displacement of the load platform which is related to the angular orientation of shaft 24 and its connected arm.

Figure 10:
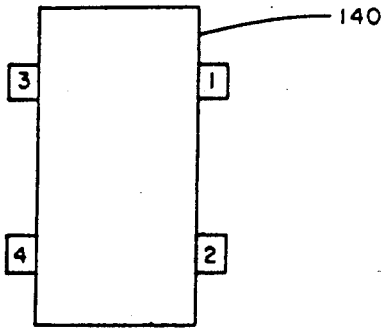
FIGS. 10–12 are diagrammatic representations illustrating one use of the sensing and transducing apparatus of the present invention as applied to vehicle suspensions.
Figure 11:
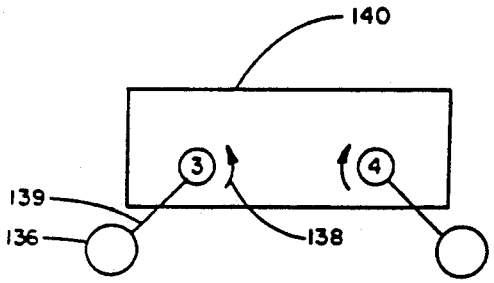
Figure 12:
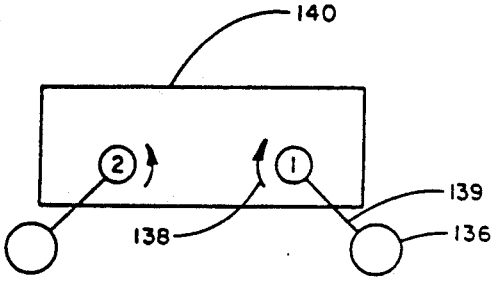

FIGS. 10–12 illustrate diagrammatically a simplified arrangement of a vehicle platform supported by a pair of front and rear wheels 136. The arrows 138 indicate the clockwise or counterclockwise rotation of suitable connecting arms 139 which would be conventionally connected to a shaft 24 of a respective one of a sensor mechanism described herein. This illustrates a situation wherein the front right and rear left connecting arms 139 move clockwise to indicate an upward movement of the supported platform or body 140. The other two connecting arms 139 move in the opposite direction when platform 140 rises.

In the dual piston embodiment shown herein, a given sensor port 99*a* or 99*b* could be clearly indicated as clockwise or counterclockwise as described to simplify initial assembly or replacement and assure that a positive pressure signal is generated at each sensor location. This would permit standardized manufacture and reduce inventory requirements.

In applications wherein the shaft 24 is not required to rotate in opposing directions depending upon its orientation, or its relative position to the load, a single sensor piston arrangement will function quite effectively as described herein to provide a means to measure displacement and transduce the same to a pressure signal without undue control circuit complexity.

It should also be noted that other mechanical forms may be substituted for cam 62 without departing from the spirit of the present invention. For example, a screw or a gearing arrangement could be used to translate displacement of an rotary or linear actuator to linear displacement of the piston 74 and hence a proportional pressure at the inlet of valve element 92.

While certain preferred embodiments of the present invention have been disclosed in detail, it is to be understood that various modifications may be adopted without departing from the spirit of the invention or scope of the following claims.

I claim:

1. A hydraulic displacement sensor and pressure transducing apparatus comprising, in combination;

a) a housing means provided with a bore having a first and second end and an inlet and outlet port;
b) piston means slideably mounted in said bore;
c) a valve element mounted in said bore in communication with said inlet and outlet ports;
d) spring means disposed in force transmitting engagement between said piston means and said valve element biasing said valve element toward a closed position relative to said inlet port;
e) movable power actuator means disposed in force transmitting relationship with said piston means;
f) means for delivering a continuous flow of hydraulic fluid at a predetermined, substantially constant flow rate to said inlet port communicating with said valve element to develop a pressure signal on the inlet side of said inlet port responsive to the linear displacement of said piston means against said spring means and proportional to the displacement of said actuator means from a given preselected position.

2. The apparatus defined in claim 1 including control valve means; a hydraulic pressure source operatively communicated to said control valve means and to said power actuator means; means for communicating a pre-selected control pressure signal and said pressure signal developed at the inlet side of said valve element to said control valve means in opposing relationship to one another to selectively control the position of said power actuator means.

3. The apparatus defined in claim 1 including means to variably adjust the axial location of said inlet port relative to the axial displacement of said piston to define the lower value of the operative pressure range developed at said inlet port relative to a pre-selected position of said power actuator means.

4. The apparatus defined in claim 1 wherein said valve element is formed by a poppet element communicating with a seat forming said inlet port and wherein said seat is mounted for adjustable axial movement between releasably fixed positions in said bore relative to said piston means.

5. The apparatus defined in claim 1 including means mounted for rotation about an axis parallel to the axis of said bore and operatively connected to said power actuator means, the angular rotation of said means about its axis being related to the linear displacement of said piston means within said bore.

6. The apparatus defined in claim 5 wherein said means mounted for rotation is a rotary cam provided with a cam surface engaging said piston means and inclined at a selected acute angle relative to a line perpendicular to its axis of rotation.

7. The apparatus defined in claim 6 wherein said housing means includes an annular slot intersecting said first end of said bore; and said cam surface includes an annular, ring-shaped configuration extending into said annular slot to engage said piston means within said bore.

8. A hydraulic displacement sensor and pressure transducing apparatus comprising in combination:

a) housing means provided with a pair of spaced, parallel extending bores, each of said bores provided with an inlet port and an outlet port;
b) a piston means slideably mounted in said of said bores;
c) a valve element mounted in each of said bores in communication with the inlet and outlet port in a respective one of said bores;
d) spring means disposed in each of said bores in force transmitting engagement between a respective one of said piston means and valve elements disposed in a respective one of said bores;
e) actuator means disposed in force transmitting relationship with each of said piston means;
f) means for providing either of a selected one of said inlet ports with a continuous flow of hydraulic fluid at a substantially constant flow rate to develop a pressure signal at said selected inlet port proportional to the linear displacement of said piston means in said bore communicating with said selected one of said inlet ports and to the displacement of said actuator means;
g) means responsive to said pressure signal developed at said selected inlet port to convert said pressure signal to an indication of the displacement of said actuator means from a preselected position.

9. A method of hydraulically sensing and transducing displacement of a movable power actuator from a preselected position to a proportional pressure comprising the steps of:

a) converting the displacement of said power actuator to a linear displacement of a piston means mounted in a bore in spring biased force transmitting engagement with a valve element communicating with an inlet port and an outlet port provided in said bore;

b) maintaining a predetermined, substantially constant flow rate of fluid through said inlet port to develop a pressure signal on the inlet side of said valve element responsive to a force applied upon said valve element by the displacement of said piston means and proportional to the displacement of said power actuator; and c) transducing said pressure signal to an indication of the displacement of said power actuator from a preselected position.

10. The method defined in claim 9 wherein said pressure signal is communicated to a control valve means operatively communicating with a hydraulic pressure source to selectively control the displacement of said power actuator responsive to a differential between a pre-selected pressure communicated to said control valve means in opposing relationship to said pressure signal developed at the inlet side of said valve element.

* * * * *